US008584806B2

(12) United States Patent
De Jong

(10) Patent No.: US 8,584,806 B2
(45) Date of Patent: Nov. 19, 2013

(54) ELEVATOR AND ELEVATOR ARRANGEMENT

(75) Inventor: Johannes De Jong, Järvenpää (FI)

(73) Assignee: Kone Corporation, Helsinki (FI)

( * ) Notice: Subject to any disclaimer, the term of this patent is extended or adjusted under 35 U.S.C. 154(b) by 841 days.

(21) Appl. No.: 12/689,970

(22) Filed: Jan. 19, 2010

(65) Prior Publication Data

US 2010/0181150 A1 Jul. 22, 2010

Related U.S. Application Data

(63) Continuation of application No. PCT/FI2008/000089, filed on Jul. 15, 2008.

(30) Foreign Application Priority Data

Jul. 20, 2007 (FI) ..... 20070562

(51) Int. Cl.
*B66B 11/08* (2006.01)
*B66B 9/00* (2006.01)
*B66B 7/06* (2006.01)

(52) U.S. Cl.
USPC ..... 187/258; 187/256

(58) Field of Classification Search
USPC ..... 187/256, 258–259
IPC ..... B66B 7/06,11/00, 11/08, 9/00, 11/04
See application file for complete search history.

(56) References Cited

U.S. PATENT DOCUMENTS

| | | | | |
|---|---|---|---|---|
| 1,896,776 A * | 2/1933 | James | ..... | 187/249 |
| 7,097,000 B2 * | 8/2006 | Teramoto et al. | ..... | 187/249 |
| 2001/0009211 A1 | 7/2001 | Kobayashi et al. | | |

FOREIGN PATENT DOCUMENTS

| | | | | |
|---|---|---|---|---|
| CA | 1036080 A | 8/1978 | | |
| EP | 1 593 640 A1 | 11/2005 | | |
| EP | 1795484 A1 * | 6/2007 | ..... | B66B 11/00 |
| EP | 1 832 543 A1 | 9/2007 | | |
| JP | 3-42487 A | 2/1991 | | |
| JP | 05201653 A * | 8/1993 | ..... | B66B 9/00 |
| JP | 06064863 A * | 3/1994 | ..... | B66B 7/06 |
| JP | 10-77171 A | 3/1998 | | |
| JP | 11-310372 A | 11/1999 | | |
| JP | 2001310883 A * | 11/2001 | ..... | B66B 7/00 |
| JP | 2004256275 A * | 9/2004 | ..... | B66B 9/00 |
| JP | 2007238331 A * | 9/2007 | ..... | B66B 7/06 |
| WO | WO-2006/070437 A1 | 7/2006 | | |
| WO | WO 2006097140 A1 * | 9/2006 | ..... | B66B 9/00 |
| WO | WO 2006113153 A2 * | 10/2006 | ..... | B66B 9/00 |

OTHER PUBLICATIONS

AIPN JPO, Machine Translation, JP Application No. 1992-213697 (JP Patent No. 406064863A), Dec. 14, 2010, pp. 1-8.*

* cited by examiner

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

Elevator, which comprises an elevator car, at least one traction sheave, at least two motors for rotating one or more traction sheaves, an elevator shaft or similar, a machine room or similar space, and hoisting roping. The elevator comprises a first motor in the machine room or similar, which is on a first level in the vertical direction, and a second motor, which is on a second level in the vertical direction, which second level is essentially higher in the vertical direction than the first level.

13 Claims, 5 Drawing Sheets

ELEVATOR AND ELEVATOR ARRANGEMENT

Figure 1:
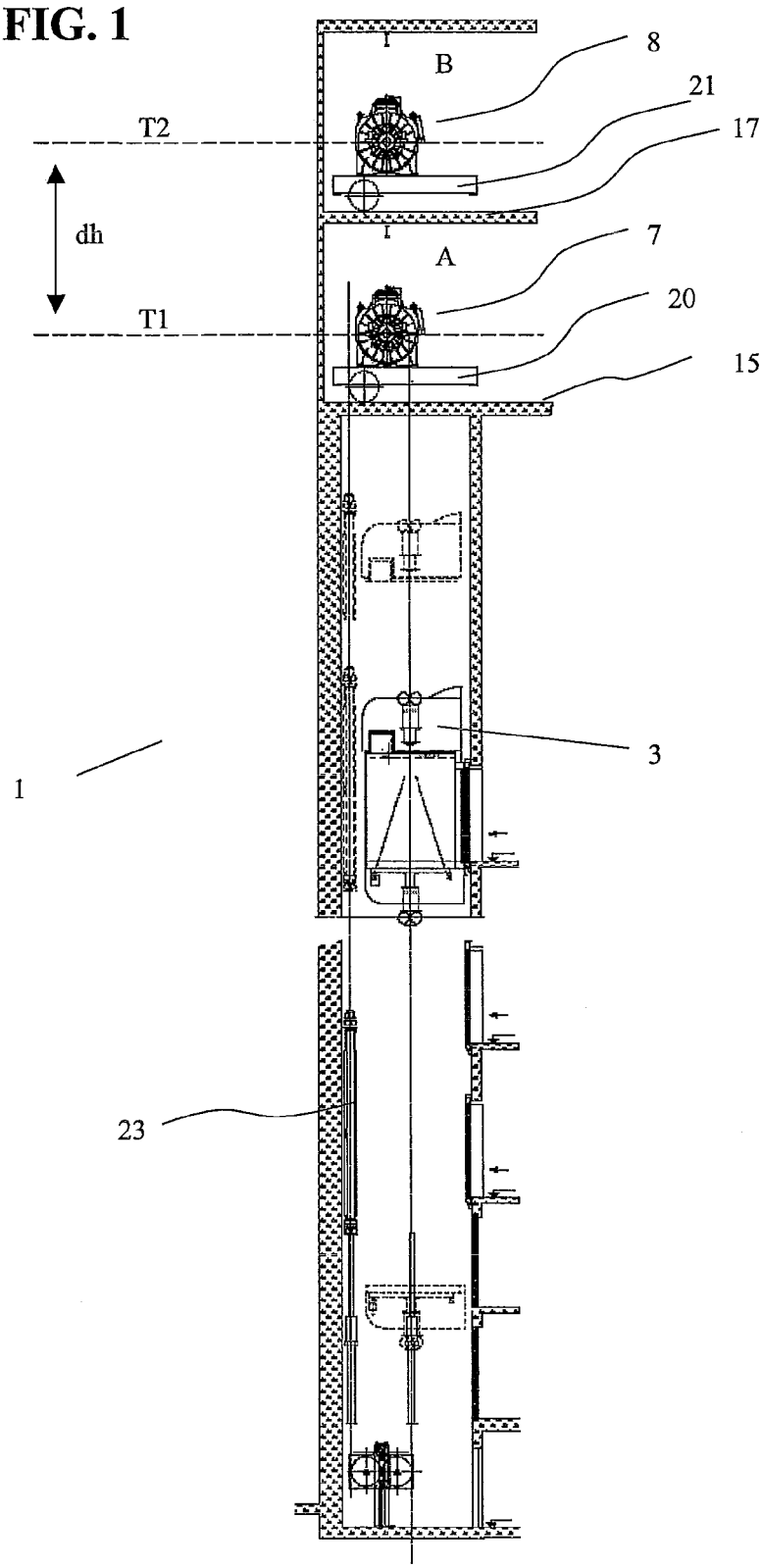

This application is a Continuation of PCT International Application No. PCT/FI2008/000089 filed on Jul. 15, 2008, which designated the United States, and on which priority is claimed under 35 U.S.C. §120. This application also claims priority under 35 U.S.C. §119(a) on Patent Application No. 20070562 filed in Finland on Jul. 20, 2007. The entire contents of each of the above documents is hereby incorporated by reference into the present application.

FIELD OF THE INVENTION

The object of the invention is an elevator as defined in the preamble of claim 1 and an elevator arrangement according to claim 15.

BACKGROUND OF THE INVENTION

In elevator systems the mass of the load moved with the motor is to a great extent dependent on the lifting height of the elevator. In elevators of high lifting heights the hoisting ropes are long and the motor must be able to move also the roping, in addition to the elevator car and the load. Long and thick ropes are heavy and set challenging power requirements for the hoisting machinery especially in acceleration situations, when the power required from the hoisting machinery is at its greatest.

Elevators of a high lifting height that move the elevator car via ropes by means of a traction sheave rotated by an electric motor are prior art. It is prior art to dimension such a large motor in terms of its output power capacity for the hoisting machinery of an elevator of a high lifting height that it performs its task alone. As the heights of buildings, and thus also lifting heights, grow it would thus become necessary to arrange increasingly larger motors in new buildings. A motor of the desired size range is not always necessarily available, however. Additionally, taking a heavy motor of large size into the machine room may be awkward owing to the cramped spaces. That being the case, in elevator systems possessing a high lifting height, in other words in high-rise elevators, using only one motor is not always advantageous. The object of the invention is suited for use in super-high-rise elevators with machine room, which have a very high lifting height even on the high-rise scale. The machinery size of these kinds of elevators may exceed, in terms of their width, even the size of the cross-section of the elevator shaft, if the machinery comprises only one extremely large motor. The machine room should thus be very wide, possibly disadvantageously wide, compared to the space taken by the elevator on the other floors of the building, in which case e.g. problems can be caused in the design of the bearing structures of the building by, among other reasons, causing a discontinuity in the structures at the point of the machine room. Another drawback in using one enormous machine size is that, owing to their rarity, production quantities are so small that their manufacturing costs would be exceptionally large.

Elevators, especially elevators without machine room, the ropes of which are moved with two traction shaves, which traction sheaves are rotated by separate electric motors, are also prior art. It is prior art to install these motors and traction sheaves in the same elevator shaft. In this case the hoisting load can be divided between two traction sheaves and the motor rotating them. One advantage, among others, is that despite the increase in machinery size, a spacious elevator car fits into the shaft and the cross-section of the elevator shaft can be utilized effectively throughout the entire length of the shaft.

PURPOSE OF THE INVENTION

The purpose of the invention is to eliminate the aforementioned drawbacks of prior-art elevators. The purpose of the invention is to implement an elevator, which is able to provide one or more of the following advantages, among others:

- The elevator does not require one large motor but instead the elevator can be implemented with a plurality of smaller motors.
- The machinery of the elevator can be arranged so that it does not require one large, especially wide elevator room.
- The hoisting load can, if so desired, be distributed in the building more evenly than before.
- The space taken in the machine room by the motors and other machinery of the elevator can be adjusted on a case-by-case basis to be very suitable for the building.
- The spatial need required of the building for taking the motor of the elevator into position during installation of the machinery can be reduced.
- The reeving or reevings of the elevator can be fixed in connection with the elevator car such that the loading is distributed in the lateral direction of the elevator car advantageously evenly and/or symmetrically.
- An elevator arrangement is achieved in the building, in which the wall structures of the building, preferably the bearing structures, continue unbroken past the machine room of the elevator.

SUMMARY OF THE INVENTION

The elevator according to the invention is characterized by what is disclosed in the characterization part of claim 1. The elevator arrangement according to the invention is characterized by what is disclosed in the characterization part of claim 15. Other embodiments of the invention are characterized by what is disclosed in the other claims. Some inventive embodiments are also discussed in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

The elevator according to the invention comprises an elevator car, at least one traction sheave, at least two motors for rotating one or more traction sheaves, an elevator shaft or similar, a machine room above the elevator shaft or similar and hoisting roping. The elevator comprises a first motor (7), which is in the machine room of the elevator (1), and which motor (7) is on a first level in the vertical direction, and a second motor, which is on a second level in the vertical direction, which second level is essentially higher in the vertical direction than the first level. In this case one advantage, among others, is that the elevator does not require one large motor but instead the elevator can be implemented with a plurality of smaller motors. The hoisting load can, if so desired, be distributed in the building more evenly than before and the space taken by the machinery of the elevator can be adjusted on a case-by-case basis to be very suitable for the building. Furthermore taking the machinery to its position during installation of the machinery can be made easier. The accessibility of the motor, the traction sheave and the other parts of the machinery in the machine room of the elevator is good, e.g. compared to elevators without machine rooms. The space requirement of the machine room in the width direction is also less than earlier.

In one embodiment of the invention the first motor, preferably an electric motor, is connected to a first traction sheave and the second motor, preferably an electric motor, is connected to a second traction sheave. An advantage in this case is that it is possible, if so desired, to more easily use two ropings. In addition, for separate traction sheaves there is not necessarily any need to arrange complex transmissions since the motors move their own traction sheaves.

In one embodiment of the invention the center of rotation of the first traction sheave is on essentially the same level in the vertical direction as the center of rotation of the first motor and the center of rotation of the second traction sheave on the same level as the center of rotation of the second motor. In this case one advantage, among others, is that traction can be arranged directly from the shaft of the motor and/or with minimal transmission while saving space.

In one embodiment of the invention the first level is in the space formed by the first machine room and the second level is in the space formed by the second machine room and the second machine room is above the first machine room. In this case an advantage is the even loading of the building as well as good access to the motor and to the traction sheave and support that is easily arranged to be robust. Taking the machines into position is also easy, because they can be moved into position in the machine room by horizontal moving. The height of the machine room can thus also be kept as the standard floor height of the building. In addition, the transverse space in the building taken by the elevator throughout the entire height of the elevator can also be formed to be more consistent than before because it is easier to form a narrow machine room. Thus the architecturally detrimental effects of the elevator can be reduced, if so desired.

In one embodiment of the invention the first motor is supported on the floor of the first machine room and the second motor is supported on the floor of the second machine room. In this case the support is robust and the machinery is easily accessible.

In one embodiment of the invention the second motor is at least partly horizontally aligned with the first motor. An advantage in this case is that the ropes moved by the higher motor are, if so desired, easy to arrange so that they pass adjacently with the ropes moved by the lower motor. The fixings of the ropes can thus easily be arranged to be adjacent to each other on the elevator car and/or on any counterweight. The ropes can, in addition, be easily arranged to pass so that they take little space in the lateral direction. Additionally the motors and other parts of the machinery do not require for their use an extensive area of the building in the lateral direction.

In one embodiment of the invention the roping passing via the first traction sheave and the roping passing via the second traction sheave are connected to the elevator car by fixing the ends of the ropings in connection with the elevator car.

In one embodiment of the invention the ropings fitted to be moved by the first traction sheave and by the second traction sheave are arranged to alternately overlap such that the rope plurality formed by the ropes of the first roping is connected to the elevator car such that a plurality of spaces remain between the individual ropes or the rope pluralities of the roping, at which point the ropes or rope pluralities of the second roping are disposed. An advantage of this is an even distribution of the loading between the ropings and safe behavior in stopping.

In one embodiment of the invention there are at least two ropings and the first ends of the ropings are fixed to the counterweight and the second ends are fixed to the elevator car. An advantage of this is that the elevator can be utilized advantageously as a high-rise elevator.

In one embodiment of the invention the first traction sheave and the second traction sheave, which is on a different level, are arranged to rotate simultaneously in the same direction when the elevator is being used. In this case an advantage is that it is possible, if so desired, to move a common counterweight with the ropings moved by the machines without complex reeving. In addition, if it is desired to move more than one counterweight with the machines such that the roping of each machine is fixed to its own counterweight, the counterweights are easy to dispose so that they travel on the same side of the elevator shaft.

In one embodiment of the invention the first motor is in the machine room and the second motor is in the same machine room or in a separate machine room. One advantage, among others, of both options is good accessibility.

In one embodiment of the invention the elevator comprises a third motor, which is on a third level, which third level is essentially higher in the vertical direction than the second level.

In one embodiment of the invention the elevator comprises at least two motors, preferably electric motors, each of which is connected to its own traction sheave. An advantage in this case is that it is possible, if so desired, to easily use more than one roping.

In one embodiment of the invention the aforementioned at least two motors move a common roping. One advantage of this is that it is not necessary to fit a number of ropings to pass adjacently to each other. This can be implemented such that the whole roping passes around the traction sheaves connected to each motor e.g. with double-wrap reeving.

In one embodiment of the invention each of the aforementioned at least two motors moves its own roping. In this case an advantage is a simple arrangement for achieving adequate friction between the traction sheaves and the ropings. The shaft loads of the motors are also advantageously distributed.

LIST OF FIGURES

In the following, the invention will be described in detail by the aid of some embodiments with reference to the attached drawings, wherein FIG. 1 diagrammatically presents one embodiment of the elevator according to the invention.

Figure 2:
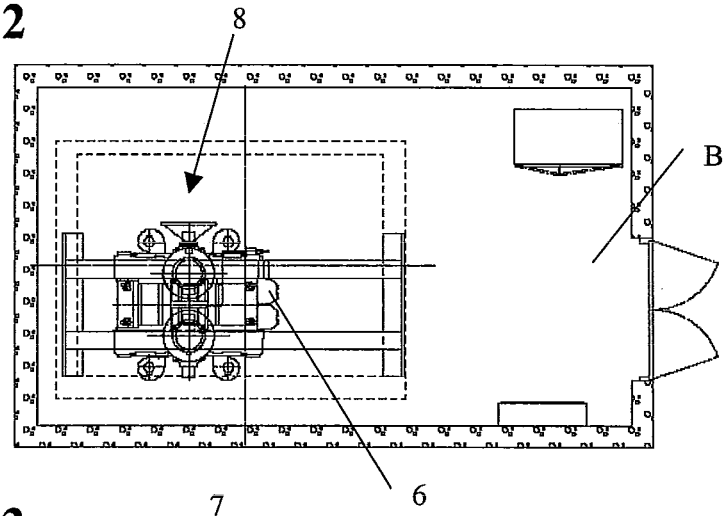

FIG. 2 presents a diagrammatic top view of the layout of the higher machine room of the elevator according to FIG. 1.

Figure 3:
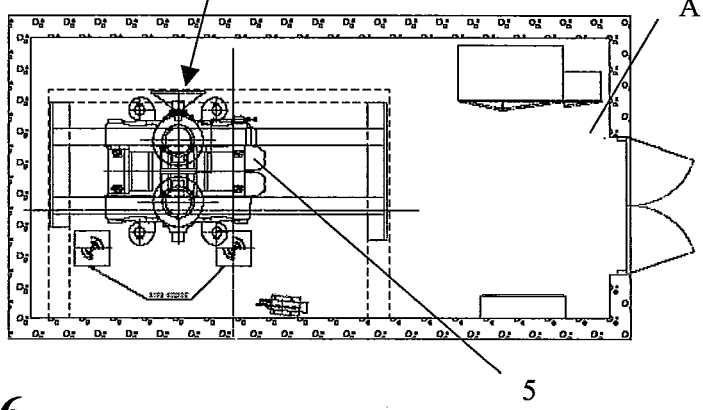

FIG. 3 presents a diagrammatic top view of the layout of the lower machine room of the elevator according to FIG. 1.

Figure 4:
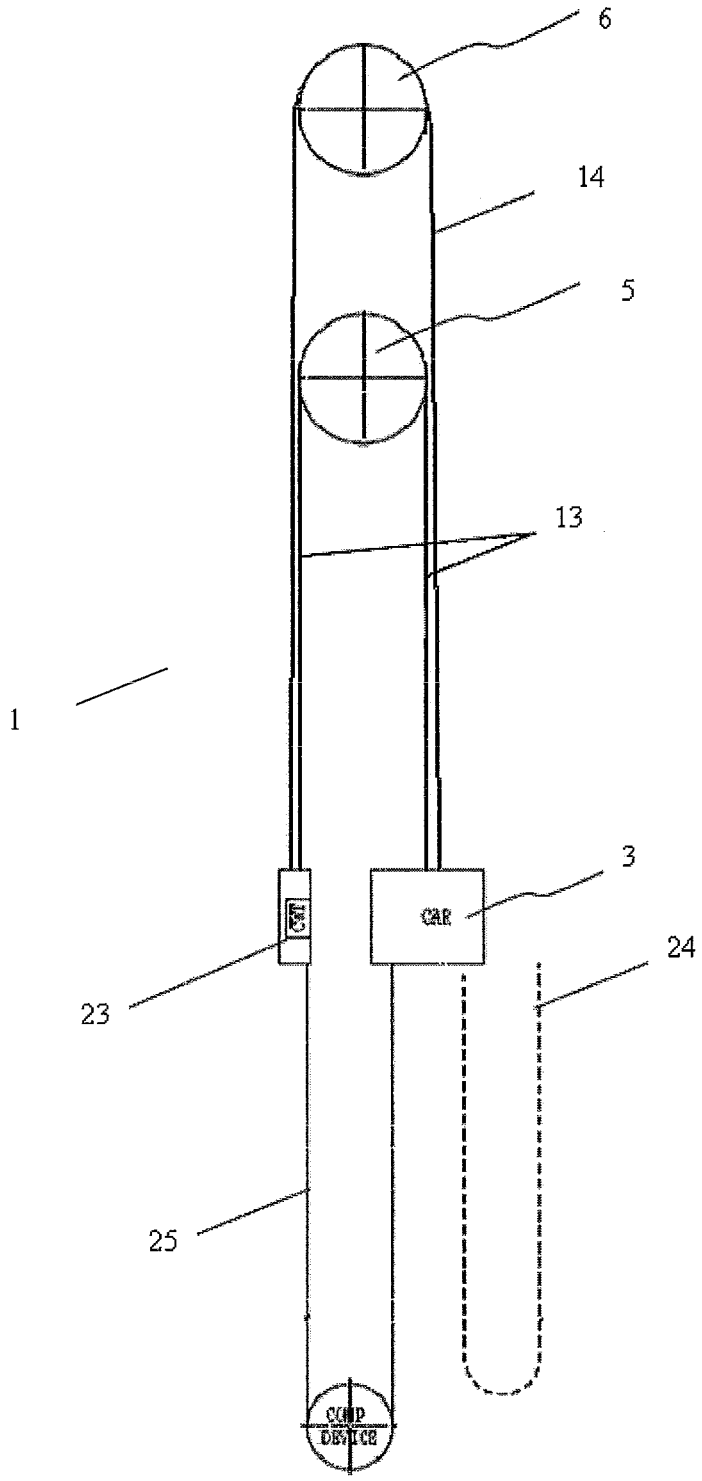

FIG. 4 diagrammatically presents the principle of the roping according to one embodiment of the elevator according to the invention.

FIGS. 5*a*-5*d* present diagrammatic top views of the connections of the reevings to the elevator car of some embodiments of the elevator according to the invention.

Figure 6:
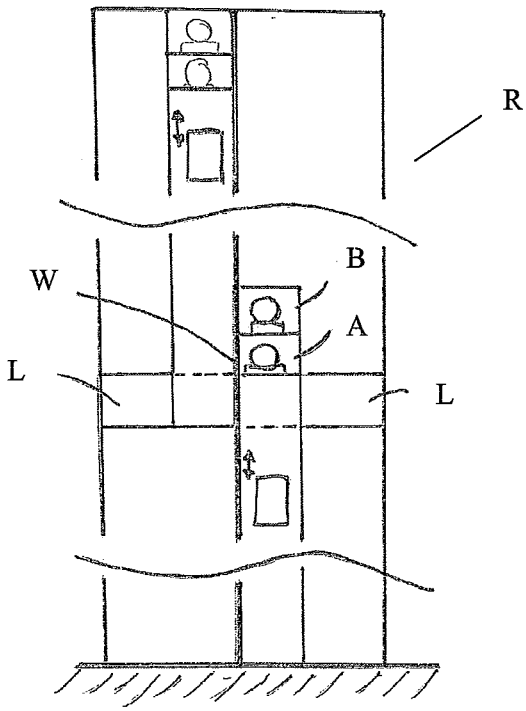

FIG. 6 presents a diagrammatic side view of the elevator/elevator arrangement according to one preferred embodiment of the invention.

Figure 7:
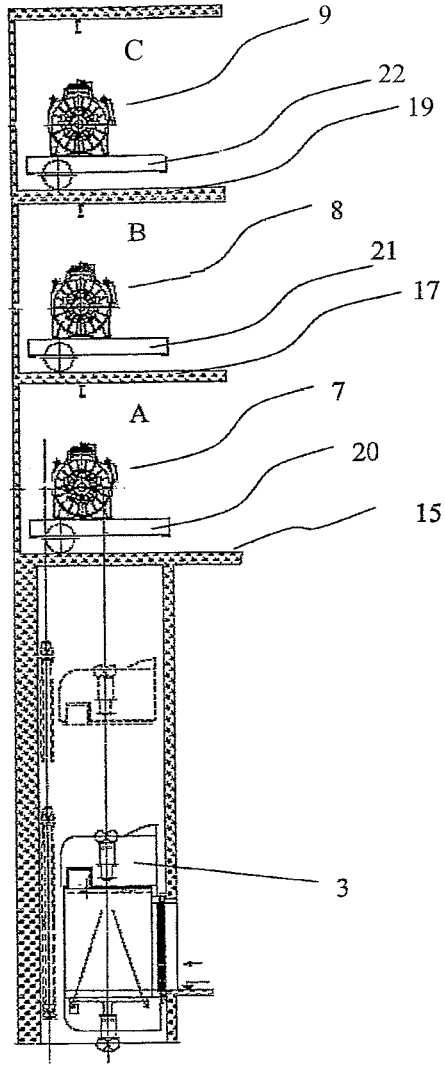

FIG. 7 diagrammatically presents another embodiment of the elevator according to the invention.

DETAILED DESCRIPTION OF THE INVENTION

FIG. 1 presents a diagrammatic illustration of an elevator according to a preferred embodiment of the invention. The elevator comprises two motors 7,8, similar to each other, of which each is arranged to rotate one traction sheave 5, 6. The motors 7, 8 are one on top of the other such that both motors are in their own machine rooms A, B, which machine rooms are one on top of the other, i.e. the second machine room B is above the first A. A floor structure 17 is between the motors. The motors are supported on the floor surfaces 15, 17 of the machine rooms A, B via the adjustable pedestals 20, 21 arranged against them. The ropes 14 moved by the motor 8 that is higher pass the ropes 13 of the motor 7 that is lower at a short distance, which in the embodiment presented in the figure is achieved by disposing the motors 7, 8 one above the other in locations that diverge slightly from each other in the horizontal axial direction. Thus the ropings 13, 14 moved via the traction sheaves 5,6 of the motors 7, 8 are guided to travel at different points. The ropings (not presented) travel in the embodiment of FIG. 1 most preferably according to FIG. 4. In the embodiment presented by FIG. 1 there are two ropings such that both the motors 7, 8 move their own ropings 13, 14 with their traction sheaves. Both the ropings 13, 14 are fixed at one of their ends to the counterweight 23 and at their other end to the elevator car 3 in the manner described in FIG. 4. In the embodiment of FIG. 1 the counterweight 23 is thus shared with the ropings 13, 14 and it is arranged to move in the elevator shaft on the side of the elevator car 3 between the elevator car 3 and the wall of the elevator shaft. The elevator of the embodiment of FIG. 1 is a 1:1 solution, which is suited to the need of high lifting heights owing to the very short rope length. The floors of both machine rooms contain apertures at points from which the ropes pass downwards into the elevator shaft. The first motor 7 is on a first level T1 in the vertical direction and the second motor 8 is on a second level T2 in the vertical direction, which second level T2 is essentially (distance dh) higher in the vertical direction than the first level T1.

FIGS. 2 and 3 illustrate the layouts of the machine rooms of elevator 1 according to the invention. The divergence between the ropings 13, 14 is arranged in this embodiment by placing the motors with their traction sheaves at different points in their axial direction. The divergence between the ropings 13, 14 of the elevator of FIGS. 1 and/or 4 can be arranged also in other ways, e.g. in the manner described elsewhere in this application. The motors 5 and 6 presented in FIGS. 2 and 3 are the types of motors that can be said to be themselves formed from a number of motors. Between the two stators is a shared rotor, which rotates the traction sheave that is integrated as a part of it.

FIG. 4 broadly illustrates by way of reference the principle of the roping of the elevator according to one embodiment of the invention, among others according to FIG. 1. The first ends of the ropings 13 and 24 are fixed to the counterweight 23 and the second ends to the elevator car 3. The roping 14 is guided to pass from the counterweight 23 over the higher traction sheave 6 and correspondingly the ropes 13 over the lower traction sheave 5, after which the ropings 13, 14 are guided in the proximity of each other to the elevator car 3. The figure also presents the compensation rope 25 between the counterweight 23 and the car 3, and the car cable 24. The divergence arranged between the ropings can be implemented in the manner described elsewhere in this application.

Figure 5A:
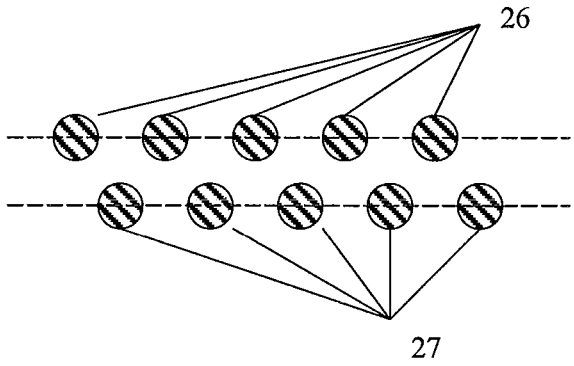
Figure 5B:
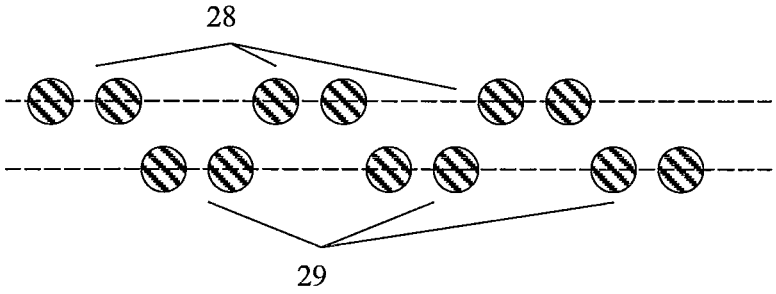
Figure 5C:
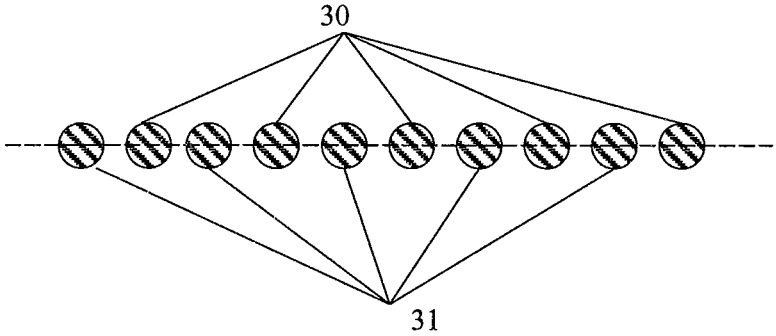
Figure 5D:
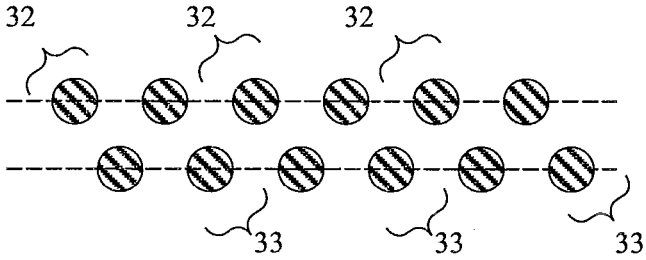

FIGS. 5*a*-5*d* illustrate preferred methods of connecting the ropings of the elevator according to the invention to the elevator car, preferably according to FIGS. 1 and 4, as viewed from above such that the cross-sections of the ropes and their placement in relation to each other are seen. The placement can be at the fixing point of the elevator car, as illustrated, and/or its proximity and/or in the top parts of the elevator shaft. Fixing the ropings to the elevator car is performed in the embodiments of FIGS. 5*a* and 5*b* such that the ropes of the roping 13 moved by the first motor 7 are fixed to the elevator car 3 or to its structures directly in rows that are a certain distance from each other. The ropes of the roping 14 moved by the second motor 8 are fixed correspondingly in rows at a certain distance from each other, but overlapping with the ropes of the roping 13. In the embodiment of FIG. 5*a* the ropes 26 of the roping 13 are disposed between the ropes 27 of the roping 14, essentially midway between the adjacent ropes of the row of ropes formed by the roping 13, as viewed from the side of the rows of ropes. In this case the distance of the rows formed by the ropes of the ropings 13 and 14 can be fitted to be smaller compared to the situation in which the ropes of the rope rows are aligned as viewed in the lateral direction. With a corresponding principle in the embodiment of FIG. 5*b* the plurality of ropes 28 of the roping 13 are disposed in the gaps formed between the plurality of ropes 29 of the roping 14, essentially at the midpoint of the gaps formed between the adjacent rope pluralities of the row of ropes formed by the roping 13, as viewed from the side of the rows of ropes. The invention of FIGS. 5*a* and 5*b* can however be utilized such that the rope gaps formed between the ropes of the rope row are smaller than the thickness of a rope. In the embodiment of FIG. 5*c* the ropes 26 of the roping 13 are disposed between the ropes 27 of the roping 14 such that the ropes of both the ropings 13, 14 are on the same line. The advantage of this embodiment is that it is possible to install traction sheaves and/or the rope grooves of them and if necessary also the motors in full alignment without a divergence. In the embodiment of FIG. 5*d* two rows of ropes are formed, in which the ropes 32, 33 of the different ropings 13, 14 are in the rope rows alternately. An advantage of this is that both the ropings can be fixed to the car 3 essentially symmetrically in relation to its center of gravity by fitting the centre of gravity between the rows of ropes. Also in the embodiment of FIG. 5*c* there can be rope pluralities that alternate instead of alternating ropes. The principles presented in FIGS. 5*a*-5*d* can also be utilized with more groups of ropes than two. The number of ropes in the plurality of ropes and/or in the rows can, depending on the need, be different to that presented in the figures. The suspension point of the ropings on the elevator car is preferably near the centre of gravity with respect to the lateral direction. Preferably the ropes of the different ropings are arranged so that they support the car symmetrically in relation to the center of gravity of the car. With this it is possible to reduce the skewing of the car in a stopping situation when the braking of the different ropings for some reason does not occur fully simultaneously. In FIG. 5*c* it is preferable to fit the center of gravity in the center point of the row and in the embodiments of FIGS. 5*a*, 5*b* and 5*d* between the rows as nearly at the center as possible.

FIG. 6 presents a building R, which comprises an elevator according to the invention, preferably according to FIG. 1 and/or 5, which is fitted into a building that still continues above the machine room B. In this case the wall(s) of the elevator shaft below the machine room (e.g. wall W in the figure) can continue to the machine room and to above the machine room B as an unbroken structure and preferably on the same line. The high-rise building presented in FIG. 6 contains a sky lobby L at the height of the top end of the first elevator. A second elevator is in use for access to higher than this height, which takes the passenger from the sky lobby to the topmost floors of the building. In the arrangement the wall W of the shaft, which is preferably a bearing structure such as e.g. a concrete wall, continues unbroken throughout the entire length of the building and forms the wall of the elevator shaft of both the elevators as well as the wall of the machine rooms. In other respects, such as with respect to the reeving, the embodiment is preferably according to what is presented elsewhere in the application. The elevator shaft and the machine room(s) are in all the embodiments preferably, but not necessarily, aligned and of the same width in their cross-sections, in which case the elevator is efficient in its use of space and easy to place in the building. The machine room and the elevator shaft are essentially aligned and essentially the same width as viewed from at least one side, preferably from all sides, of the elevator.

In the following the invention will be described at a general level. In the elevator according to the invention it is essential that the motors are in a machine room or in machine rooms at different heights in the vertical direction with respect to each other. The distance dh is preferably so big that it is possible to arrange the motors one above the other and in the lateral direction at least partly aligned. That being the case, the distance dh is preferably over one-half of the vertical dimension of the motor. More preferably dh is even larger, preferably such that a space of over 1 meter remains between the lower motor and the higher motor, or its support, in which case the advantage is good accessibility. Most preferably each motor has its own separate machine room. Preferably the motors and/or the traction sheaves are installed at least partly one above the other, most preferably in the way that the ropes moved by the motor that is higher pass the ropes of the motor that is lower at a sufficient distance without touching the lower motor and the parts of its machinery or the roping moved by the lower motor. This situation is achieved preferably such that the motors 7, 8 and/or at least their traction sheaves 5, 6 and/or the rope grooves of their traction sheaves are not fully aligned in the lateral direction. The traction sheaves 5, 6 can be placed at slightly different points in the lateral direction, in which case the roping 14 moved by the higher motor 8 passes the rim of the traction sheave 5 and the roping rotated by the lower motor approximately at a distance of the magnitude of the radial horizontal divergence of the traction sheaves and/or the rope grooves of them. The divergence can thus be arranged to be that desired by means of the placement of the traction sheaves. The divergence can be e.g. 0.1 cm-50 cm, preferably 1-20 cm, most preferably 1-5 cm. In this case the motors can still be essentially or at least partly aligned one above the other, since motors of large size are involved. Alternatively the passing can be implemented with an axial divergence of the traction sheaves and/or of the rope grooves of them, in which case the ropes moved by the higher motor do not pass at the same point as earlier. This is implemented preferably such that the ropes of the roping coming from higher up travel at a distance from each other in a row and the ropes coming from the lower traction sheave travel in a similar manner but at different points to the extent that they travel between the ropes coming from higher up. This can be enabled by, among other things, traction sheaves that have a different groove pattern or by using only every second groove in similar traction sheaves. Arranging a divergence in the positioning of the rope grooves enables traction sheaves that are aligned one above the other. At its simplest this can be implemented such that the same traction sheaves pull the hoisting rope only in every second rope groove and every other rope groove is free. In this case the traction sheave uses grooves for traction that are at a different points than the lower traction sheave. The divergence can be implemented preferably also such that the divergence is in the radial horizontal direction as well as in the axial direction of the traction sheaves 5, 6. In this case the ropes coming from higher up can be arranged to pass between the ropes coming from below, but slightly farther outwards. Alternatively, according to yet another embodiment the passing can be implemented, or it can be facilitated, e.g. in embodiments of a radial divergence, by means of a separate diverting pulley or diverting pulleys by guiding the roping from the higher traction sheave, at least on one side, downwards such that it passes around at least at least one diverting pulley, which moves the path of passage of the rope to an adequate distance from the parts of the lower machinery and/or from the roping moved by it. The traction sheaves in this arrangement rotate preferably in the same directions and the ropings of the higher and of the lower traction sheave travel in the same directions on corresponding sides of their traction sheaves. In this case the traction sheaves and if necessary the motors can if so desired be placed essentially aligned in the lateral direction and a divergence does not necessarily need to be arranged in another way.

The motors are supported preferably directly or via support structures, e.g. via stands, auxiliary platforms or frames, on the floor surfaces of the machine rooms. The invention can also however be utilized such that at least some of the motors are supported on a platform or platforms arranged above the floor surface of the machine room. In this case the level can be e.g. a projection arranged to protrude from the wall structure. According to one embodiment the motors are arranged one above the other in the same machine room such that the second motor is supported above the first motor by means of a platform or support structure in the machine room. In this case more than one machine room is not needed. This can be implemented by means of a metal framework, an auxiliary platform or a projection arranged to protrude from the wall structure.

In the application the term level refers to a height plane in the vertical direction e.g. from the surface of the ground, the surface of the sea or the bottom floor of a building. The term motor refers to any motor whatsoever, because the advantages of the invention can be achieved regardless of the motor type. However, most preferably the motor is an electric motor in all the embodiments. In this case the motors can be permanent-magnet motors, asynchronous, DC motors, AC motors or combinations of these types or of other prior art types.

What is essential is that instead of one motor a number of motors, which are at levels that differ to each other, are used in an elevator with machine room. The solution of the motors being on different levels as presented can be utilized in many ways, e.g. with one or more ropings. Most preferably each motor on a different level moves one roping, but the solution can also be implemented such that the motors move, each via its own traction sheave, a common rope/roping. Most preferably the elevator according to the invention has a 1:1 traction ratio, but the invention can also be utilized as an elevator of a 1:2 traction ratio or of greater traction ratios. Most preferably there are two motors and there are two ropings, but the invention can also be utilized with the types of embodiments in which there are more than two motors, e.g. three or four, in which case preferably the amount of ropings corresponds to the amount of motors. In this case a third motor can be placed in a corresponding way above the arrangement illustrated by FIG. 1, which is preferably an electric motor connected to its own traction sheave. For example, as shown in FIG. 7, a third motor 9, which is on a third level in a third machine room C, which third level is essentially higher in the vertical direction than the second level. The third motor 9 is supported on a floor surface 19 on a pedestal 22. In addition the invention can be applied such that the amount of ropings can also be smaller or greater than the amount of traction sheaves and/or motors. There can be more than one motor on one level, e.g. such that two or more motors move a common traction sheave by means of a gear or without a gear.

It is obvious to the person skilled in the art that the invention can be utilized also in elevators in which the hoisting rope is belt-like such as e.g. a cogged belt. The invention can be utilized also such that the ropings can be connected to a common counterweight or to their own counterweights. Additionally, it is obvious that the embodiments relating to the placement of the ropings in relation to each other described in FIGS. 5*a*-5*d* can also be utilized in elevators in which other parts, e.g. motors, are arranged in a different way to what is described in this application. It is also obvious that the invention can also be utilized in elevators without counterweight. It is also obvious that each roping can comprise one rope or a plurality of ropes. It is also obvious that the traction sheaves one above the other can be fitted to rotate in opposite directions, which is advantageous e.g. if only one roping and double-wrap is used e.g. in connection with the machinery solution of FIG. 1. Neither do the motors need to be similar to each other.

It is obvious to the person skilled in the art that the invention is not limited to the embodiments described above, in which the invention is described using examples, but that many adaptations and different embodiments of the invention are possible within the scope of the inventive concept defined by the claims presented below.

The invention claimed is:

1. An elevator, comprising:
an elevator car;
at least one traction sheave;
at least two motors for rotating one or more traction sheaves of the least one traction sheave;
an elevator shaft;
a first machine room above the elevator shaft;
a second machine room above the first machine room;
at least one hoisting roping, the at least one hoisting roping including a first roping and a second roping separate from the first roping;
a first motor of the at least two motors, which is in the first machine room of the elevator, and which motor is on a first level in a vertical direction; and
a second motor of the at least two motors, which is on a second level in the vertical direction, which second level (T2) is essentially higher in the vertical direction than the first level,
wherein the first motor is connected to a first traction sheave of the at least one traction sheave, and the second motor is connected to a second traction sheave of the at least one traction sheave,
wherein the first roping passes via the first traction sheave and the second roping passes via the second traction sheave and the first and second roping are both connected to the car, and
wherein the first level is in a space formed by the first machine room and the second level is in a space formed by the second machine room.

2. An elevator arrangement in a building, wherein the arrangement comprises an elevator according to claim 1.

3. The elevator arrangement according to claim 2, wherein the bearing structure of the building forms at least one wall of the elevator shaft, which bearing structure continues unbroken to above the machine room of the elevator.

4. The elevator arrangement according to claim 2, wherein the machine room and the elevator shaft are essentially aligned and essentially the same width as viewed from at least one side of the elevator.

5. The elevator according to claim 1, wherein a center of rotation of the first traction sheave is on essentially the same level in the vertical direction as a center of rotation of the first motor and a center of rotation of the second traction sheave on the same level as a center of rotation of the second motor.

6. The elevator according to claim 1, wherein the first motor is supported on the floor of the first machine room and the second motor is supported on the floor of the second machine room.

7. The elevator according to claim 1, wherein the second motor is at least partly horizontally aligned with the first motor.

8. An elevator, comprising:
an elevator car;
at least one traction sheave;
at least two motors for rotating one or more traction sheaves of the at least one traction sheave;
an elevator shaft;
a machine room above the elevator shaft;
at least one hoisting roping, the at least one hoisting roping including a first hoisting roping having a plurality of ropes and a second hoisting roping having a plurality of ropes;
a first motor of the at least two motors, which is in the machine room of the elevator, and which motor is on a first level in a vertical direction; and
a second motor of the at least two motors, which is on a second level in the vertical direction, which second level (T2) is essentially higher in the vertical direction than the first level,
wherein the at least one hoisting roping includes a first hoisting roping fitted to be moved by a first at least one traction sheave of the traction sheaves and a second hoisting roping fitted to be moved by a second at least one traction sheave traction sheave of the traction sheaves are arranged to alternately overlap such that the first hoisting roping is connected to the elevator car in a manner that a plurality of spaces remain between individual ropes or grouping of ropes of the first hoisting roping and individual ropes or grouping of ropes of the second hoisting roping.

9. The elevator according to claim 1, wherein first ends of the first and second ropings are fixed to a counterweight and second ends of the first and second ropings are fixed to the elevator car.

10. The elevator according to claim 1, wherein the first traction sheave and the second traction sheave are arranged to rotate simultaneously in the same direction when the elevator is being used.

11. The elevator according to claim 1, wherein the first motor is in machine room and the second motor is in the same machine room or in a different machine room.

12. The elevator according to claim 1, wherein the first motor is supported on a floor of the first machine room and the second motor is supported on a floor of the second machine room.

13. An elevator, comprising:
an elevator car;
at least one traction sheave;
at least two motors for rotating one or more traction sheaves of the at least one traction sheave;

an elevator shaft;

a machine room above the elevator shaft; and at least one hoisting roping;

a first motor of the at least two motors, which is in the machine room of the elevator, and which motor is on a first level in vertical direction;

a second motor of the at least two motors, which is on a second level in the vertical direction, which second level (T2) is essentially higher in the vertical direction than the first level; and a third motor of the at least two motors, which is on a third level, which third level is essentially higher in the vertical direction than the second level, wherein the at least one hoisting roping includes a first hoisting roping fitted to be moved by a first traction sheave of the at least one traction sheave, a second hoisting roping fitted to be moved by a second traction sheave of the at least one traction sheave and a third hoisting roping fitted to be moved by a third traction sheave of the at least one traction sheave, and wherein the first hoisting roping, the second hoisting roping and the third hoisting roping are connected to said elevator car.

* * * * *